US009610512B2

(12) United States Patent
Bae

(10) Patent No.: US 9,610,512 B2
(45) Date of Patent: Apr. 4, 2017

(54) DINOSAUR MODEL WITH MULTI-JOINT ASSEMBLY

(71) Applicants: FUTURE CYBER, INC., Gwangju (KR); Jung-Bin Bae, Gyeonggi-do (KR)

(72) Inventor: Jung-Bin Bae, Gyeonggi-do (KR)

(73) Assignee: FUTURE CYBER, INC., Gwangju (KR)

( * ) Notice: Subject to any disclaimer, the term of this patent is extended or adjusted under 35 U.S.C. 154(b) by 0 days.

(21) Appl. No.: 14/787,165

(22) PCT Filed: Apr. 21, 2014

(86) PCT No.: PCT/KR2014/003429
§ 371 (c)(1),
(2) Date: Oct. 26, 2015

(87) PCT Pub. No.: WO2015/163491
PCT Pub. Date: Oct. 29, 2015

(65) Prior Publication Data

US 2016/0107092 A1 Apr. 21, 2016

(51) Int. Cl.
*A63H 3/16* (2006.01)
*A63H 33/08* (2006.01)
(Continued)

(52) U.S. Cl.
CPC ..... *A63H 3/16* (2013.01); *A63H 3/46* (2013.01); *A63H 9/00* (2013.01); *A63H 33/086* (2013.01)

(58) Field of Classification Search
CPC ... A63H 3/00; A63H 3/04; A63H 3/16; A63H 3/46
See application file for complete search history.

(56) References Cited

U.S. PATENT DOCUMENTS 1,347,993 A 7/1920 Dawley
5,480,341 A 1/1996 Plakos
(Continued)

FOREIGN PATENT DOCUMENTS

JP 08-243265 9/1996
KR 20-0218824 4/2001
(Continued)

OTHER PUBLICATIONS

PCT Search Report from PCT/KR2014/003429 mailed Jan. 20, 2015.
Search Report from corresponding German Patent Application No. 11 2014 001 957.7.

*Primary Examiner* — John Ricci
(74) *Attorney, Agent, or Firm* — Fay Sharpe LLP

(57) ABSTRACT

Disclosed is a dinosaur model with multi-joint assembly that allows the user to grow creative idea and pursue self-lead learning during the assemblage of relatively many parts into the finished article and which is designed to allow free modification of actions and to provide a definite anatomical structure of dinosaur during the sequential assembly of a skeletal frame. It comprises: a skeletal frame in which skull, cervical vertebra, trunk skeleton, and tail bone units are sequentially connected through joints and the trunk skeleton unit is articulated with limb bone units; an integumental frame, responsible for appearance, comprising head integument, neck integument, trunk integument, tail integument, and limb integument units that are associated with the skull, the cervical vertebra, the trunk skeleton, the tail bone, and the limb bone units, respectively; and a connection member, intercalated between the skeletal frame and the integumental frame, for connecting the frames each other.

12 Claims, 8 Drawing Sheets

(51) Int. Cl.
*A63H 3/46* (2006.01)
*A63H 9/00* (2006.01)

(56) References Cited

U.S. PATENT DOCUMENTS

| | | | | | |
|---|---|---|---|---|---|
| 5,752,869 | A * | 5/1998 | Huff | A63H 3/16 | 446/102 |
| 5,941,712 | A * | 8/1999 | Smith | A63H 3/16 | 273/157 R |
| 6,626,732 | B1 | 9/2003 | Chung | | |
| 7,514,093 | B2 * | 4/2009 | Sugiura | A01N 59/14 | 424/405 |
| 2012/0015177 | A1 * | 1/2012 | Kim | B32B 5/16 | 428/328 |

FOREIGN PATENT DOCUMENTS

| | | |
|---|---|---|
| KR | 10-2003-0074580 | 9/2003 |
| KR | 20-0434385 | 12/2006 |

* cited by examiner

DINOSAUR MODEL WITH MULTI-JOINT ASSEMBLY

This Application is a Section 371 National Stage Application of International Application No. PCT/KR2014/003429, filed Apr. 21, 2014, the contents of which are hereby incorporated by reference.

BACKGROUND OF THE INVENTION

Technical Field

The present invention relates to a dinosaur model with multi-joint assembly. More particularly, the present invention relates to a dinosaur model with multi-joint assembly that allows the user to grow his or her creative idea and pursue self-lead learning during the assemblage of relatively many parts into the finished article and which is designed to allow free modification of actions and to provide a definite anatomical structure of dinosaur during the sequential assembly of a skeletal frame having a joint structure and an integumental frame composed of separate a head, a neck, a trunk, legs, and a tail.

Background Art

Dinosaurs are a diverse group of animals of the clade Dinosauria. They first appeared during the Triassic period, and were the dominant terrestrial vertebrates from the start of the Jurassic until the end of the Cretaceous. Also, the fossil record indicates the involvement of Pterosaurs and Ichthyosaur, which were flying reptiles, and large marine reptiles, respectively, as members of the clade Dinosauria.

The taxon Dinosauria, meaning 'terrible reptile', was formally coined by paleontologist Sir Richard Owen, who used it in August, 1841 in the Academic Research Development Meeting of England to express the great fossilized bones of Iguanodon found in 1825.

Collectively, dinosaurs as a clade are divided into two primary branches, Saurischia and Ornithischia, which are distinguished most noticeably by their pelvic structures, lizard- and bird-hipped joints, respectively. Saurischia includes the theropods, which are exclusively bipedal with a wide variety of carnivorous diets (e.g., *tyrannosaurus, allosaurus*, etc.), and sauropodomorphs, which are long-necked, quadrupedal herbivores (e.g., *brachiosaurus, supersaurus*, etc.). Ornithischia were primarily herbivores classified into four species including ornithopoda with long legs like birds, thyreophora with armor-like skins, ankylosauria with club-like tails, and ceratopsia with horns.

Such dinosaurian characteristics are very important factors by which dinosaurs can be distinguished from one another. Typically, students with an interest in dinosaurs learn the skill of distinguishing types of dinosaurs and widen their knowledge about dinosaurs through observation of fossilized bones.

Meanwhile, various models are fabricated and marketed for learning and studying skeletal structures of dinosaurs. Also, the models are prepared in the form of toys with the aim of arousing student interest, but conventional dinosaur models or toys have use limitations because they are provided as completely integrated forms.

Thus far, most dinosaurian models have been prepared as empty or latex-saturated figures that have rubber or plastic integuments or as wood or plastic puzzles, or limited to those composed of simple skeletal bones. Even though upgraded, those models are enabled only to do simple actions.

For example, Korean Patent Unexamined Application Publication No. 10-2003-0074580 (issued on 19 Sep. 2003) discloses a dinosaur toy having a skeletal frame composed of a spine, a tail, a head, forelegs and hind legs, a chest, a pelvis, and ribs. They are separate planar blocks, each having at least one concave fitting attachment, and can be assembled into or disassembled from the dinosaur model by fitting or detaching. Korean Utility No. 20-0434385 (issued 14 Dec. 2006) describes a dinosaur toy composed of blocks of main bones that can be assembled and move with the aid of motors and gears, thereby arousing an interest in dinosaurs and improving learning effects.

The conventional dinosaur models described above, however, have too small a number of assembly parts to allow the user to grow creative ideas and purse self-lead learning. In addition, the conventional models are limited in providing the user with accurate anatomical structures of dinosaurs because the parts have planar shapes and are designed to be simply fitted to each other for assembly.

DISCLOSURE

Technical Problem

It is therefore an object of the present invention to provide a dinosaur model with multi-joint assembly that allows the user to grow his or her creative idea and pursue self-lead learning during the assemblage of relatively many parts into the finished article and which is designed to allow free modification of actions and to provide a definite anatomical structure of dinosaur during the sequential assembly of a skeletal frame having a joint structure and an integumental frame composed of separate a head, a neck, a trunk, legs, and a tail.

Technical Solution

In order to accomplish the above object, the present invention provides dinosaur model with multi-joint assembly, comprising: a skeletal frame in which a skull unit, a cervical vertebra unit, a trunk skeleton unit, and a tail bone unit are sequentially connected through joints and the trunk skeleton unit is articulated with limb bone units; an integumental frame, responsible for the appearance of the dinosaur, comprising a head integument unit, a neck integument unit, a trunk integument unit, a tail integument unit, and limb integument units that are associated with the skull unit, the cervical vertebra unit, the trunk skeleton unit, the tail bone unit, and the limb bone units, respectively; and a connecting member, intercalated between the skeletal frame and the integumental frame, for connecting the members to each other.

In one preferred embodiment of the skeletal frame according to the present invention, the skull unit is formed of a plurality of skull members that are connected to each other, the trunk skeleton unit of a plurality of trunk skeleton members that are connected to each other, the tail bone unit of a plurality of tail bone members that are articulated with each other, the limb bone unit of a plurality of limb bone members that are articulated with each other. The articulation applied to the skeletal frame may be achieved with any one selected from among a ball and socket joint connection member, a hinge joint connection member, an ellipsoidal joint connection member, a condylar joint connection member, a pivot joint connection member, and a gliding joint connection member.

In another preferred embodiment of the present invention, the head integument unit is composed of a plurality of separate head integument members, the trunk integument unit is composed of a plurality of separate trunk integument members, and tail integument unit is composed of a plurality of separate tail integument members, and the limb integument unit is composed of a plurality of separate leg integument members.

In another preferred embodiment of the present invention, the connection member has a rod shape with an "I" or "H" cross section, at opposite ends of which a protrusion is formed, and each of the skeletal frame and the integumental frame is provided with a groove into which the protrusion of the connection member is fitted.

In another preferred embodiment of the present invention, each of the skeletal frame, the integumental frame and the connection member is injection molded into a planar layer structure composed of many parts that is detachably integrated in a planar frame.

In another preferred embodiment of the present invention, each of the skeletal frame, the integumental frame, and the connection member is made of a synthetic resin suitable for assembly and painting, the synthetic resin being selected from among a polypropylene resin, a polystyrene resin, a polyethylene resin, and an ABS rein.

In another preferred embodiment of the present invention, the skeletal frame, the integumental frame, and the connection member are injection molded from a polypropylene or ABS resin, a polystyrene resin, and a polyethylene resin, respectively.

In another preferred embodiment of the present invention, the skeletal frame, the integumental frame and the connection member is injection molded from a composition comprising a ratio of 100 parts by weight of the synthetic resins and 2 to 25 parts by weight of an infrared radiation-emitting and anion-generating ore powder respectively.

In another preferred embodiment of the present invention, the ore powder is prepared from an ore selected from the group consisting of illite, sericite, mica, and muscovite.

In another preferred embodiment of the present invention, the skeletal frame, the integumental frame and the connection member is injection molded from a composition comprising a ratio of 100 parts by weight of the synthetic resins, 2 to 25 parts by weight of an infrared radiation-emitting and anion-generating ore powder, and 1 to 3 parts by weight of an inorganic ionic antibacterial agent respectively.

In another preferred embodiment of the present invention, the inorganic ionic antibacterial agent is prepared by mixing 0.3 to 0.7 parts by weight of silver nitrate in 100 parts by weight of distilled water.

In another preferred embodiment of the present invention, the limb bone unit of the skeletal frame further comprises a wing bone part and the limb integument unit of the integumental frame further comprises a wing part.

Advantageous Effect

As described above, while assembling into a miniature product the relatively many parts of the dinosaur model with multi-joint assembly 1 including parts constituting the skull unit, the cervical vertebra unit, the trunk skeleton unit, the tail bone unit, the limb bone unit of the skeletal frame, the head integument unit, neck integument unit, trunk integument unit, tail integument unit, limb integument unit of integumental frame, the connection members for connecting the skeletal frame and the integumental frame to each other, and other joint connection members, users can have their interest in dinosaur and spatial perception stimulated. Also, the user can grow creative ideas and develop self-lead learning abilities by coloring the integumental frame to create a realistic model of a dinosaur.

Moreover, the dinosaur model with multi-joint assembly according to the present invention is designed to freely modify actions and to provide a definite anatomical structure of dinosaur during the sequential assembly of a skeletal frame having a joint structure and an integumental frame composed of separate a head, a neck, a trunk, legs, and a tail.

The dinosaur model with multi-joint assembly according to the present invention may be not only valuable as a personal creative collection piece, but is also applicable for educational exhibition, thereby inducing a learning effect and arousing an interest in palaeobios.

BRIEF DESCRIPTION OF THE DRAWINGS

The above objects, other features and advantages of the present invention will become more apparent by describing the preferred embodiments thereof with reference to the accompanying drawings, in which.

PREFERRED EMBODIMENTS OF THE INVENTION

Figure 1:
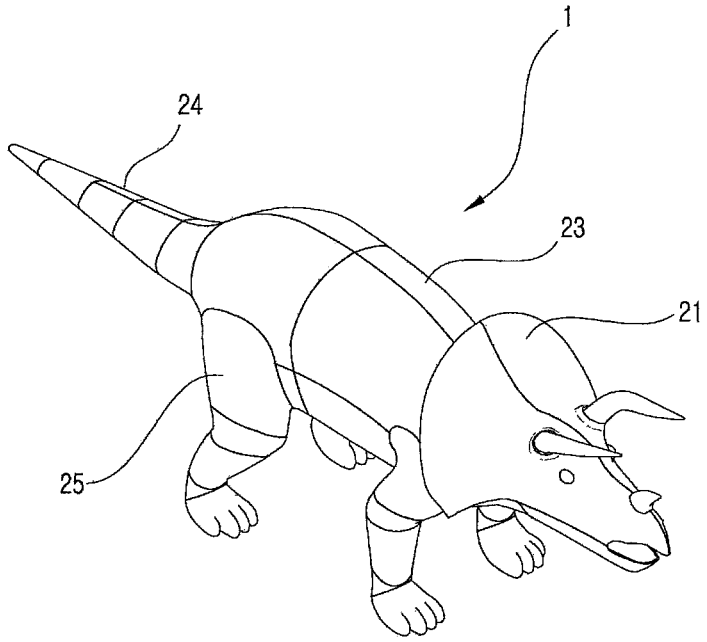
FIG. 1 is a perspective view of dinosaur model with multi-joint assembly according to one embodiment of the present invention.
Figure 2:
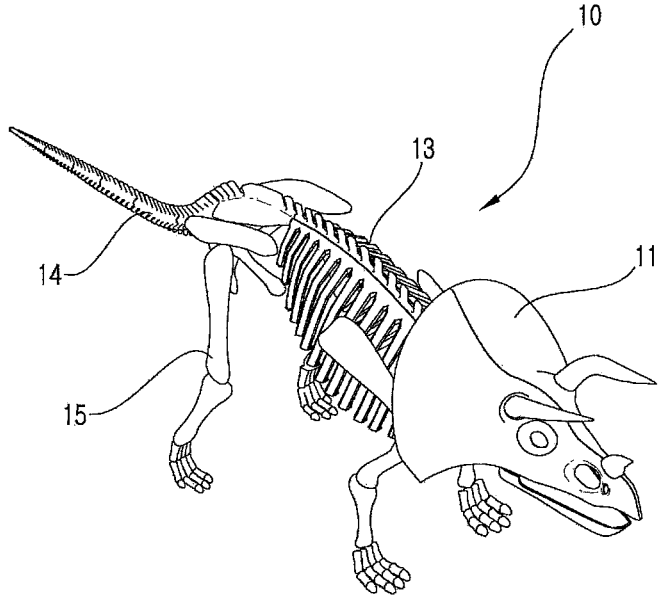
FIG. 2 is a perspective view showing a skeletal frame of the dinosaur model with multi-joint assembly according to one embodiment of the present invention.

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

An aspect of the present invention addresses dinosaur model with multi-joint assembly that allows the user to grow his or her creative idea and pursue self-lead learning during the assemblage of relatively many parts into the finished article and which is designed to allow free modification of actions and to provide a definite anatomical structure of dinosaur during the sequential assembly of a skeletal frame having a joint structure and an integumental frame composed of separate a head, a neck, a trunk, legs, and a tail. With reference to FIGS. 1 to 9, the multi-joint dinosaur model comprises: a skeletal frame 10, accounting for the skeletal structure of the dinosaur, in which a skull unit 11, a cervical vertebra unit 12, a trunk skeleton unit 13, and a tail bone unit 14 are sequentially articulated to one another, and the trunk skeleton unit 13 is articulated to limb bone units 15; an integumental frame, responsible for the appearance of the dinosaur, comprising a head integument unit 21, a neck integument unit 22, a trunk integument unit 23, a tail integument unit 24, and limb integument units 25 that are associated with the skull unit 11, the cervical vertebra unit 12, the trunk skeleton unit 13, the tail bone unit 14, and the limb bone units 15, respectively; and a connecting member 30, intercalated between the skeletal frame 10 and the integumental frame 20, for connecting them each other.

Herein, the skeletal frame 10 is responsible for the skeletal structure of the dinosaur model with multi-joint assembly 1, and is designed to sequentially connect the skull unit 11, the cervical vertebra unit 12, the trunk skeleton unit 13, and the tail bone unit 14 to one another through joints, with the limb bone units 15 articulated to the trunk skeleton unit 13. In the skeletal frame 10, the skull unit 1 is formed of a plurality of skull members that are connected to each other; the trunk skeleton unit 13 is formed of a plurality of trunk skeleton members, such as a spine member, a rib member, a scapula member, and a pelvis member, that are connected to each other; the tail bone unit 14 is formed of a plurality of tail bone members that are articulated with each other; the limb bone unit is formed of a plurality of limb bone members, such as upper and lower forelimb bone members, forelimb toe members, upper and lower hindlimb bone members, and hind limb toe members, that are articulated with one another.

The articulation applied to the skeletal frame 10 may be achieved with any one selected from among a ball and socket joint connection member, a hinge joint connection member, an ellipsoidal joint connection member, a condylar joint connection member, a pivot joint connection member, and a gliding joint connection member. Preferably, the joint connection members are made of a tough resin, such as an ABS resin (acrylonitrile butadiene styrene copolymer) or an AS resin (acrylonitrile styrene copolymer). Preferably, the articulation is achieved between the skull unit 11 and the cervical vertebra unit 12 by with a ball and socket joint connection member (A) that enables the bone members to move in all directions, between the cervical vertebra unit 12 and the trunk skeleton unit 1 by a gliding joint connection member (B), and between the trunk skeleton unit 13 and the tail bone unit 14 by a hinge joint (c) that permits motion only in one direction vertically, and between a tail bone parts 14*a* comprising the tail bone unit 14 by a hinge joint (c') that permits motion only in one direction horizontally.

Particularly, the gliding joint connection member (B) through which the cervical vertebra unit 12 and the trunk skeleton unit 13 are articulated with each other, comprises the following: an upper hinge connection part (B1) formed at an upper rear end of the cervical vertebra unit 12; a lower hinge connection part (B2) formed at a lower rear end of the cervical vertebra unit 12; a lower hinge axial part (B3), formed at a front end of the trunk skeleton unit 13 and hingedly jointed to the lower hinge connection part (B2); a guide groove (B4) formed on front, opposite sides of the trunk skeleton unit 13; and a gliding joint connector B5 in which an upper hinge axial part (B5') to be hingedly jointed to the upper hinge connection part (B1) is formed at a front site on the lower side of the connector and a slidingly movable bracket (B5") to be engaged with the guide groove (B4) is formed at a rear site on the lower side of the connector, whereby the cervical vertebra unit 12 can smoothly move in a vertical direction.

For use in articulation between the trunk skeleton unit 13 and the limb bone unit 15, an arc joint groove is formed across the scapula member of the trunk skeleton unit 13. At an upper end of the upper forelimb bone of the limb bone unit 15, a cyclic joint member (D') that is engaged with and slides along the arc joint groove (D) of the scapula member. Articulation between the pelvis member of the trunk skeleton unit 13 and the upper hind limb bone of the limb bone unit 15 is achieved by a ball and socket joint connection member (A; not in detail shown) that enables the bone members to move in all directions.

In addition, connection between the upper and the lower forelimb member of the limb bone unit 15 and between the upper and the lower hind limb member of the limb bone unit 15 is preferably accounted for by condylar joint connection member (E). Further, a hinge joint connection member (C") that permits motion in one direction accounts for connection between the lower forelimb bone member and the toe bone members in the limb bone unit 15. The hinge joint connection member (C") is also applied to the connection between the lower hind limbs bone member and the toe bone members in the limb bone unit 15.

Figure 3:
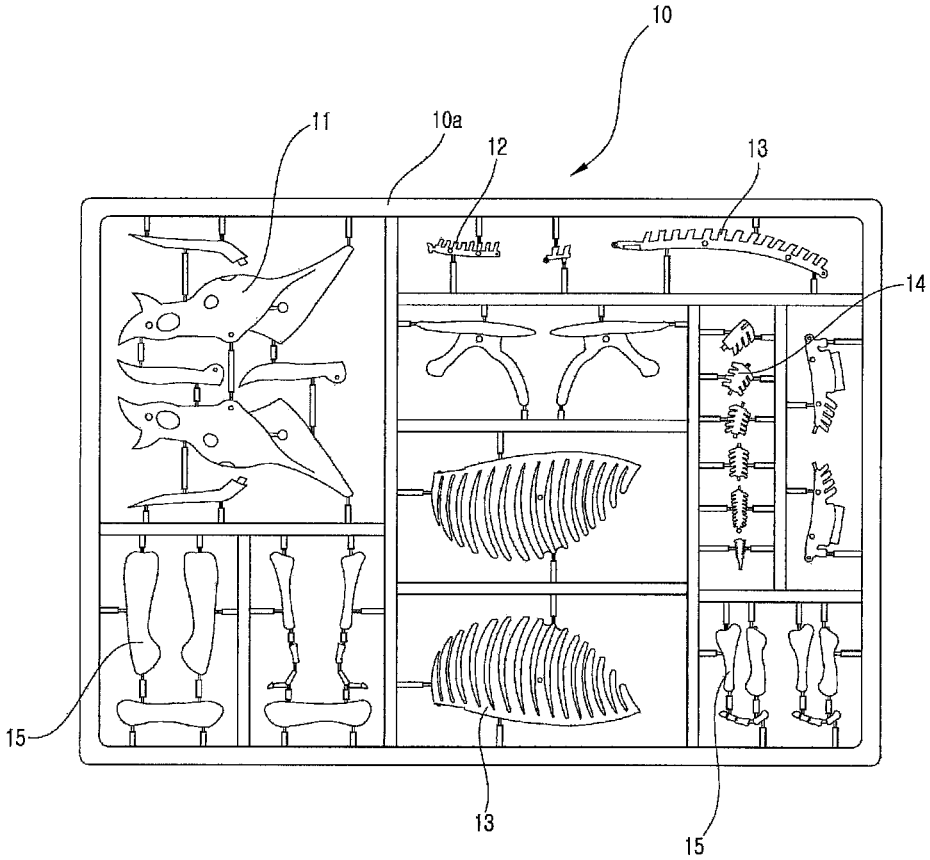
FIG. 3 is a plane view showing a skeletal frame of the dinosaur model with multi-joint assembly according to one embodiment of the present invention.
Figure 4:
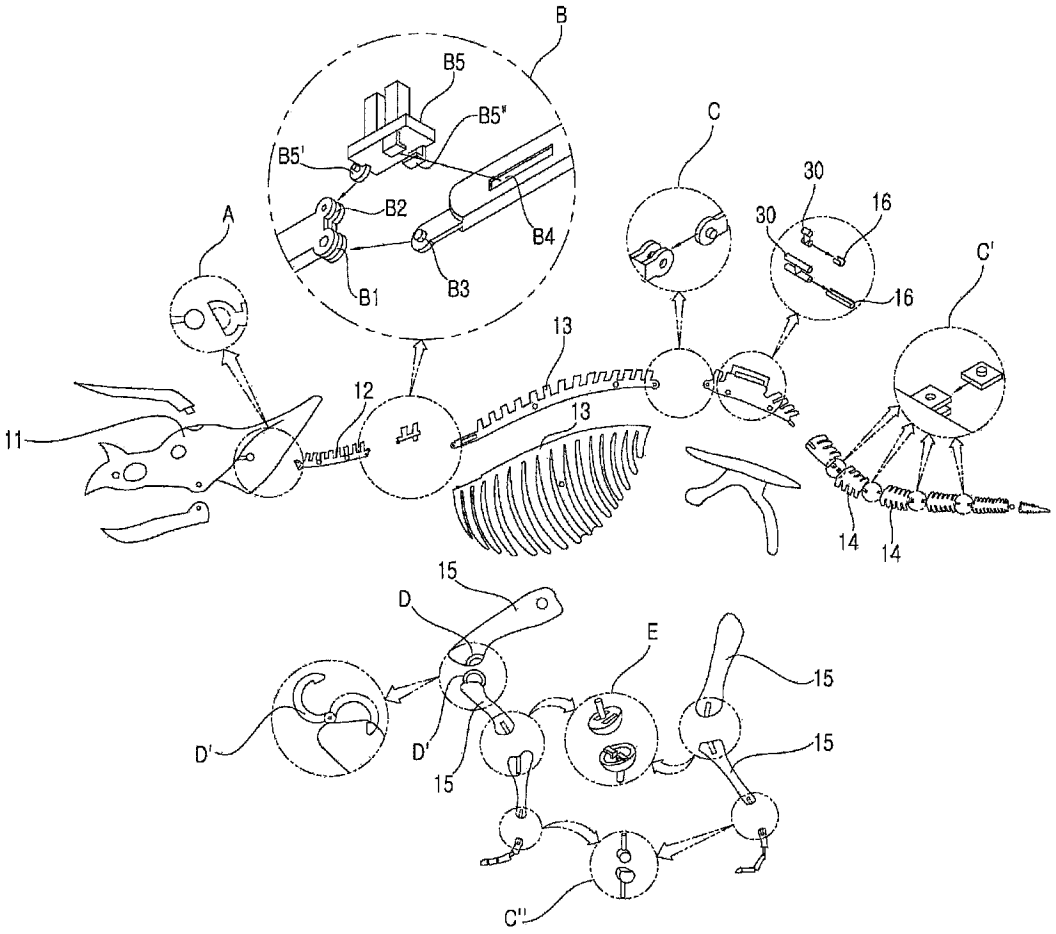
FIG. 4 is an assembly view for the skeletal frame of the dinosaur model with multi-joint assembly according to one embodiment of the present invention.

As can be seen in FIG. 3, the skeletal frame 10 is preferably injection molded, together with the joint connection members described above, into a planar layer structure composed of many parts that is detachably integrated in a planar frame 10*a*. In addition, the skeletal frame 10 may be made of one synthetic resin selected from among a polypropylene resin, a polyethylene resin, and an ABS rein. More preferred is a polypropylene resin or an ABS resin because of their high support strength.

The integumental frame 20 is applied to the skeletal frame 10. The integumental frame 20 is responsible for the general exterior of the dinosaur model, and includes a head integument unit 21 to be applied to the skull unit of the skeletal frame 10; a neck integument unit 22 to be applied to the cervical vertebra unit 12 of the skeletal frame 10; a trunk integument unit 23 to be applied to the trunk skeleton unit 13 of the skeletal frame 10; a tail integument unit 24 of the tail bone unit 14 of the skeletal frame 10; and a limb integument unit 25 to be applied to the limb bone unit 15 of the skeletal frame 10.

Moreover, the head integument unit 21 of the integumental frame 20 is composed of many separate head integument members that are preferably connected to each other by corresponding grooves and protrusions or by an engagement membrane. Likewise, the trunk integument unit 23 of the integumental frame 20 is composed of many separate trunk integument members that are preferably connected to each other by corresponding grooves and protrusions or by an engagement membrane. The tail integument unit 24 of the integumental frame 20 is composed of many separate tail integument members that are each of a conical frustum shape and which have such a curved end at rear region that they can move upon the fitting engagement of the cone. In addition, the limb integument unit 25 is composed of many separate leg integument members that are preferably connected to each other by corresponding grooves and protrusions or by an engagement membrane.

Particularly in the integumental frame 20, the integument members are preferably provided with groove and protrusion structures at sections thereof facing to each other so that they can be easily engaged and are not moved.

Figure 5:
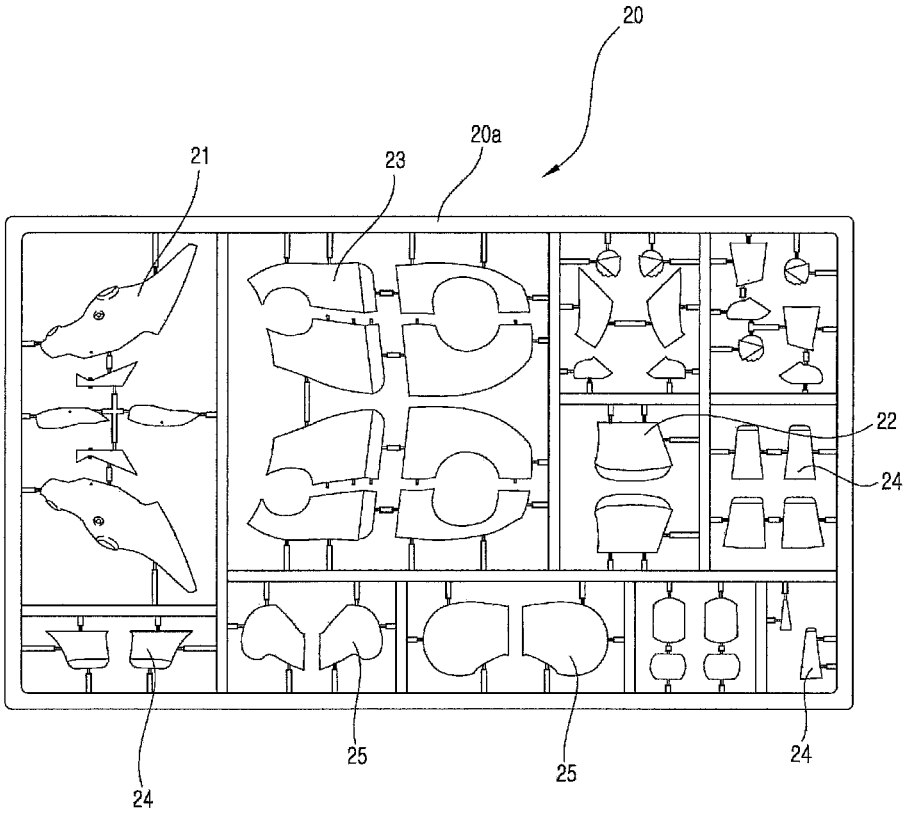
FIG. 5 is a plane view showing a planar layer structure of an integumental frame of the dinosaur model with multi-joint assembly according to one embodiment of the present invention.

The integumental frame 20, as shown in FIG. 5, is preferably injection molded into a planar layer structure composed of many parts that is detachably integrated in a planar frame 20*a*. In addition, the integumental frame 20 may be made of one synthetic resin selected from among a polypropylene resin, a polyethylene resin, and an ABS rein. More preferred is a polypropylene resin because it is soft and suitable for painting.

When the dinosaur model with multi-joint assembly 1 is concerned with the flying reptile Pterosaur, preferably the limb bone unit 15 of the skeletal frame 10 comprises a wing bone part and the limb integument unit 25 of the integumental frame 20 comprises a wing part.

Between the skeletal frame 10 and the integumental frame 20 is positioned the connection member 30 that functions to connect the members of the skeletal frame 10 to those of the integumental frame 20. Preferably, the connection member has a rod shape with an "I" or "H" cross section, at opposite ends of which fitting protrusions are formed.

Figure 6:
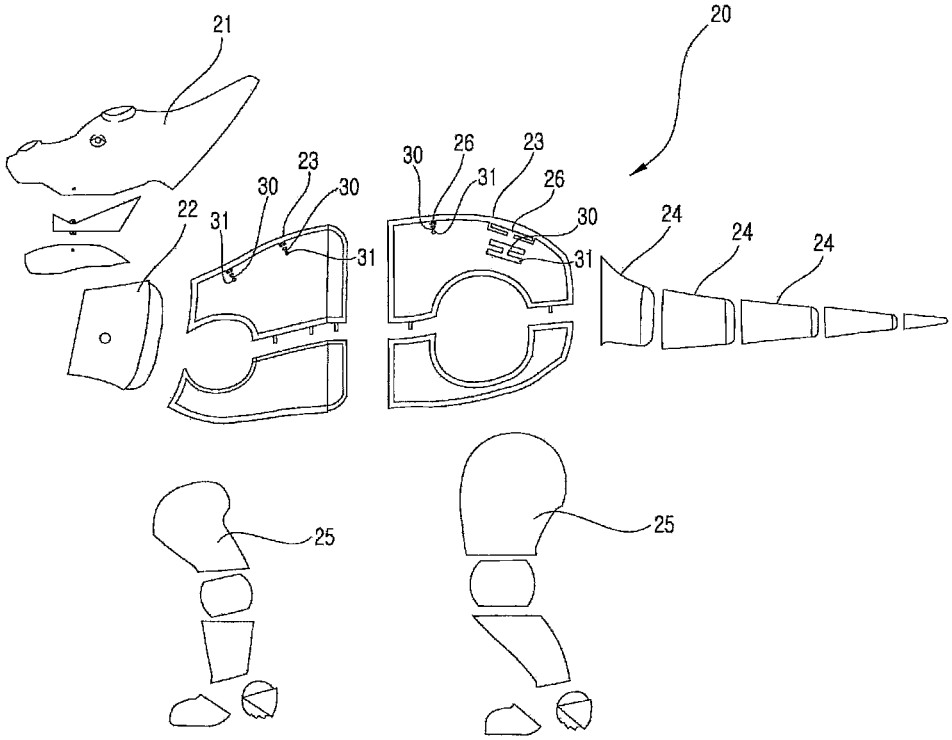
FIG. 6 is an assembly view for the planar layer structure of an integumental frame of the dinosaur model with multi-joint assembly according to one embodiment of the present invention.
Figure 8:
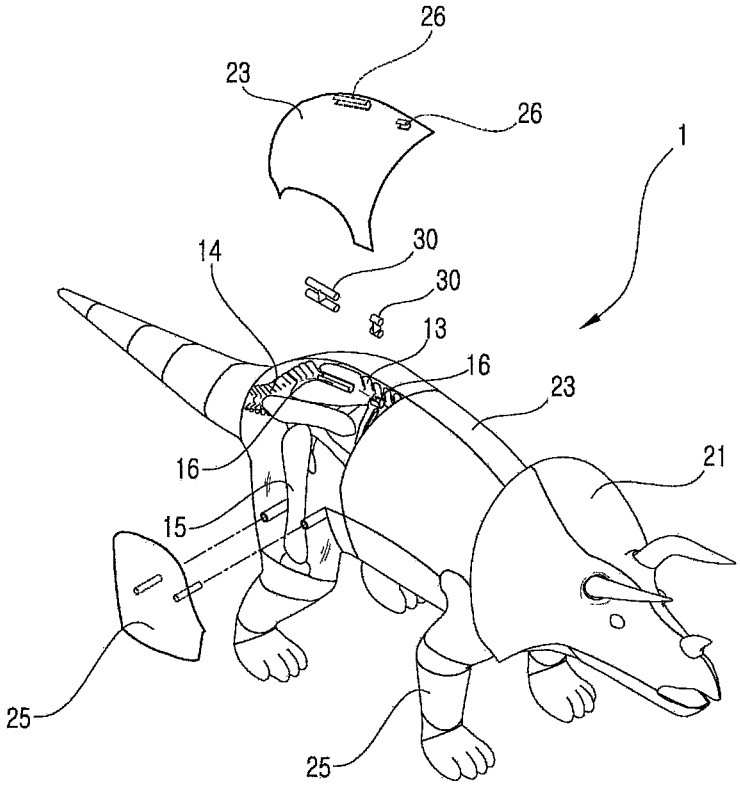
FIG. 8 is an assembled, perspective view illustrating the function of a connection member in the assembly, multi-joint dinosaur model according to one embodiment of the present invention.

For connection therebetween by the above-described connection member 30, the members of the skeletal frame 10 and the integumental frame 20, as shown in FIGS. 6 and 8, are preferably provided with fitting grooves 16 and 26 to be fitted with fitting protrusions of the connection member 30.

Figure 7:
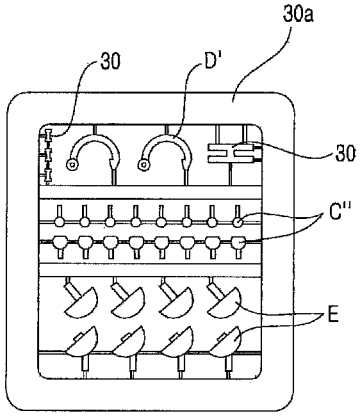
FIG. 7 is a plane view showing a planar layer structure of connection members and joint connection of the dinosaur model with multi-joint assembly according to one embodiment of the present invention.

As can be seen in FIG. 7, the connection member 30 is preferably injection molded into a planar layer structure composed of many parts that is detachably integrated in a planar frame 30*a*. In addition, the connection member 30 may be made of one synthetic resin selected from among a polypropylene resin, a polyethylene resin, and an ABS rein. More preferred is a polypropylene resin because of its high toughness and impact resistance.

In addition, the dinosaur model with multi-joint assembly 1 according to the present invention may further comprise an accessory or special ornament such as a horn, a cuirasse, a nail, a bump, etc. The accessory or ornament may be injection molded from a PC (polycarbonate) resin or a polystyrene resin. Preferred is a polystyrene resin in terms of injection process and cost.

For use in the injection molding into the skeletal frame 10, the integumental frame 20, and the connection member 30, the synthetic resins may preferably comprise 2 to 25 parts by weight of a far-infrared radiation-emitting and anion-generating ore powder per 100 parts by weight thereof respectively. The far-infrared radiation-emitting and anion-generating ore powder may be powdered from an ore selected from the group consisting of illite, sericite, mica, and muscovite.

When the far-infrared radiation-emitting and anion-generating ore powder is used in an amount of less than 2 parts by weight per 100 parts by weight of the resin, the emission of far-infrared radiation is minimal and the generation of anions is limited. On the other hand, more than 25 parts by weight of the far-infrared radiation-emitting and anion-generating ore powder may reduce the elasticity and ductility of the resin. Accordingly, the far-infrared radiation-emitting and anion-generating ore powder may be preferably used in an amount of 2 to 25 parts by weight per 100 parts by weight of the synthetic resin.

The far-infrared radiation-emitting and anion-generating ore powder improves the tensile strength and impact resistance of the injection molded products, that is, the skeletal frame 10, the integumental frame 20 and the connection member 30. Further, illite may bring about an effect of reducing the production cost when it is mixed with the expensive plastic resin.

The far-infrared radiation-emitting and anion-generating ore powder may range in particle size from 300 to 3,000 meshes, and preferably from 300 to 1,000 meshes in consideration of economical effects including production cost.

In another embodiment of the present invention, each of the skeletal frame 10, the integumental frame 20, and the connection member 30 is preferably injection molded from a composition comprising a weight part ratio of 100:2~25:1~3 of a synthetic resin:a far-infrared radiation-emitting and anion-generating ore powder:an inorganic ionic antibacterial agent. In this regard, so long as it exhibits inhibitory activity against *E. coli* and *Pseudomonas aeruginosa*, any inorganic ionic antibacterial agent can be used. Preferably, the antibacterial agent may be prepared by mixing 0.3 to 0.7 parts by weight of silver nitrate with 100 parts by weight of distilled water.

Before injection molding into the skeletal frame 10, the integumental frame 20 and the connection member 30 in an injector, chips of the selected synthetic resin material are loaded into an apparatus equipped with a stirrer, and melted at 200 to 250° C. and then stirred together with the far-infrared radiation-emitting and anion-generating ore powder with particle size from 300 to 1,000 meshes. If necessary, the organic ionic antibacterial agent may be added. In this context, the organic ionic antibacterial agent may be slowly added to the apparatus and stirred at a speed of 50 rpm for 5 min or longer.

Accordingly, while assembling into a miniature product the relatively many parts of the dinosaur model with multi-joint assembly 1 including parts constituting the skull unit 11, the cervical vertebra unit 12, the trunk skeleton unit 13, the tail bone unit 14, the limb bone unit 15 of the skeletal frame 10, the head integument unit 21, neck integument unit 22, trunk integument unit 23, tail integument unit 24, limb integument unit 25 of integumental frame 20, the connection members 30 for connecting the skeletal frame 10 and the integumental frame 20 to each other, and other joint connection members, users can stimulate their interest in dinosaurs and develop their spatial perception. Also, the user can grow creative ideas and pursue self-lead learning by coloring the integumental frame 20 to create a realistic model of a dinosaur.

Moreover, the dinosaur model with multi-joint assembly 1 according to the present invention is designed to allow free modification of actions and to provide a definite anatomical structure of dinosaur during the sequential assembly of the skeletal frame 10 having joint structures that enables various motions, and the integumental frame composed of separate body parts.

Being injection molded from a composition comprising a ratio of 100 wt parts:2~25 wt parts of a synthetic resin:a far-infrared radiation-emitting and anion-generating ore powder, the dinosaur model with multi-joint assembly 1 of the present invention exerts various effects of far-infrared radiation. The dinosaur model with multi-joint assembly 1 prepared from a composition comprising a ratio of 100 wt parts:15 wt parts of a synthetic resin:a 300-mesh sericite powder of the present invention was measured for far-infrared emissivity and radiant energy, and the results are summarized in Table 1, below. The measurements were obtained relative to black mass using FT-IR spectrometer.

TABLE 1

| Test Item | | Test Result | Test Method |
|---|---|---|---|
| Far-Infrared Emission (40° C.) | Emissivity (5 to 20 μm) | 0.901 | KCIM-FIR 1005 |
| | Radiant Energy ($w/m^2$) | $3.62 \times 10^2$ | |

When injection molded from a composition comprising a weight part ratio of 100:2~25:1~3 of a synthetic resin:a far-infrared radiation-emitting and anion-generating ore powder:an inorganic ionic antibacterial agent, the dinosaur model with multi-joint assembly 1 of the present invention shows inhibitory activity against *E. coli* and *Pseudomonas aeruginosa* so that even infants or children can safely use the model. Particularly, the dinosaur model with multi-joint assembly 1 prepared from a composition comprising a weight ratio of 100:15:2.5 of a synthetic resin:300-mesh sericite:silver nitrate solution was observed to exhibit high inhibitory activity against *Escherichia coli* ATCC25922 and *Pseudomonas aeruginosa* ATCC 154220 as measured by KICM-FIR 1002 (SHAKE FLASK METHOD).

Figure 9:
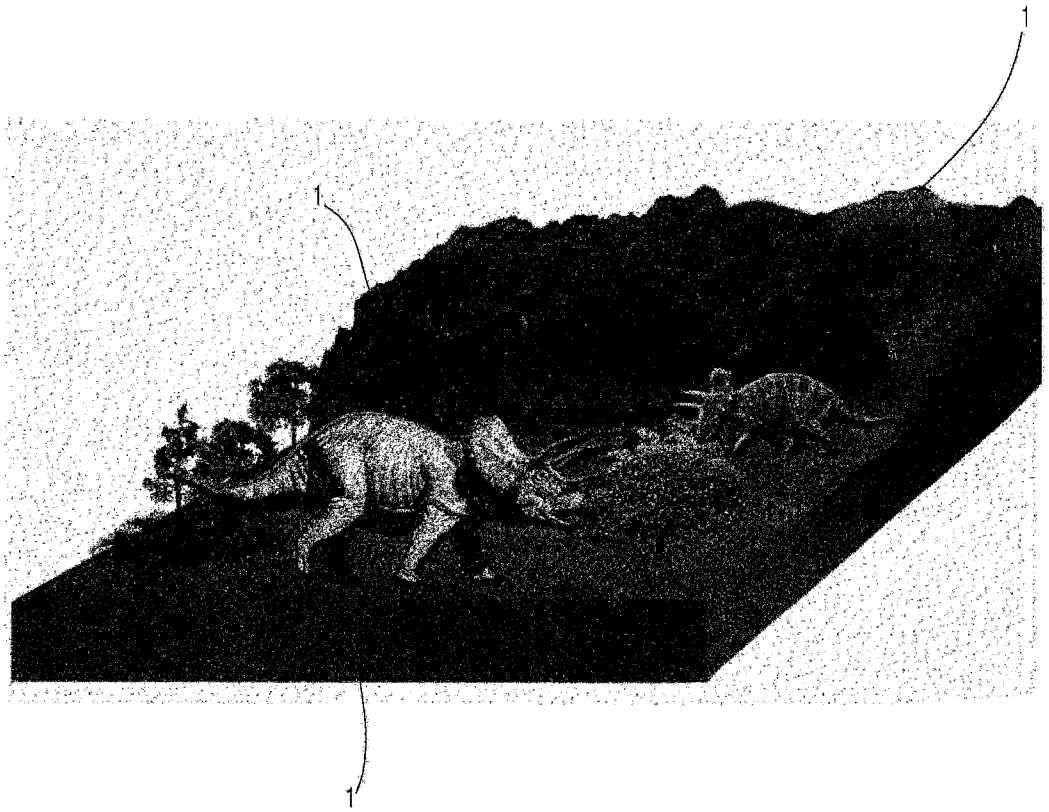
FIG. 9 is a virtual image illustrating an exhibition example of dinosaur model with multi-joint assemblies of the present invention.

The dinosaur model with multi-joint assembly 1 according to the present invention may be not only valuable as a personal creative collection piece, but is also applicable for educational exhibition as shown in FIG. 9, thereby inducing a learning effect and arousing an interest in palaeobios.

INDUSTRIAL APPLICABILITY

The assembly, multi-joint dinosaur model according to the present invention may be not only valuable as a personal creative collection, but also applicable for educational exhibition.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

What is claimed is:

1. A dinosaur model with multi-joint assembly, comprising:

a skeletal frame, responsible for a skeleton of the dinosaur model, in which a skull unit, a cervical vertebra unit, a trunk skeleton unit, and a tail bone unit are sequentially connected through joints and the trunk skeleton unit is articulated with limb bone units;

an integumental frame, responsible for the appearance of the dinosaur, comprising a head integument unit, a neck integument unit, a trunk integument unit, a tail integument unit, and limb integument units that are associated with the skull unit, the cervical vertebra unit, the trunk skeleton unit, the tail bone unit, and the limb bone units, respectively; and a connection member, intercalated between the skeletal frame and the integumental frame, for connecting the frames to each other, said connection member having a rod shape with an "I" or "H" cross section, at opposite ends of which a protrusion is formed, and each of the skeletal frame and the integumental frame is provided with a groove into which the protrusion of the connection member is fitted.

2. The dinosaur model with multi-joint assembly of claim 1, wherein the skull unit is formed of a plurality of skull members that are connected to each other, the trunk skeleton unit is formed of a plurality of trunk skeleton members that are connected to each other, the tail bone unit is formed of a plurality of tail bone members that are articulated with each other, the limb bone unit is formed of a plurality of limb bone members that are articulated with each other.

3. The dinosaur model with multi-joint assembly of claim 2, wherein the articulation applied to the skeletal frame is achieved with any one selected from among a ball and socket joint connection member, a hinge joint connection member, an ellipsoidal joint connection member, a condylar joint connection member, a pivot joint connection member, and a gliding joint connection member.

4. The dinosaur model with multi-joint assembly of claim 2, wherein the head integument unit is composed of a plurality of separate head integument members, the trunk integument unit is composed of a plurality of separate trunk integument members, and tail integument unit is composed of a plurality of separate tail integument members, and the limb integument unit is composed of a plurality of separate leg integument members.

5. The dinosaur model with multi-joint assembly of claim 1, wherein each of the skeletal frame, the integumental frame and the connection member is injection molded into a planar layer structure composed of many parts that is detachably integrated in a planar frame.

6. The dinosaur model with multi-joint assembly of claim 5, wherein each of the skeletal frame, the integumental frame, and the connection member is made of a synthetic resin suitable for assembly and painting of the dinosaur model, the synthetic resin being selected from among a polypropylene resin, a polystyrene resin, a polyethylene resin, and an ABS rein.

7. The dinosaur model with multi-joint assembly of claim 6, wherein the skeletal frame, the integumental frame, and the connection member are injection molded from a polypropylene or ABS resin, a polystyrene resin, and a polyethylene resin, respectively.

8. The dinosaur model with multi-joint assembly of claim 5, wherein the skeletal frame, the integumental frame and the connection member is injection molded from a composition comprising a ratio of 100 parts by weight of synthetic_resins and 2 to 25 parts by weight of an infrared radiation-emitting and anion-generating ore powder respectively.

9. The dinosaur model with multi-joint assembly of claim 8, wherein the ore powder is prepared from an ore selected from the group consisting of illite, sericite, mica, and muscovite.

10. The dinosaur model with multi-joint assembly of claim 8, wherein the skeletal frame, the integumental frame and the connection member is injection molded from a composition comprising a ratio of 100 parts by weight of the synthetic resins, 2 to 25 parts by weight of an infrared radiation-emitting and anion-generating ore powder, and 1 to 3 parts by weight of an inorganic ionic antibacterial agent respectively.

11. The dinosaur model with multi-joint assembly of claim 10, wherein the inorganic ionic antibacterial agent is prepared by mixing 0.3 to 0.7 parts by weight of silver nitrate in 100 parts by weight of distilled water.

12. A dinosaur model with multi-joint assembly, comprising:

a skeletal frame, responsible for a skeleton of the dinosaur model, in which a skull unit, a cervical vertebra unit, a trunk skeleton unit, and a tail bone unit are sequentially connected through joints and the trunk skeleton unit is articulated with limb bone units;

an integumental frame, responsible for the appearance of the dinosaur, comprising a head integument unit, a neck integument unit, a trunk integument unit, a tail integument unit, and limb integument units that are associated with the skull unit, the cervical vertebra unit, the trunk skeleton unit, the tail bone unit, and the limb bone units, respectively;

a connection member, intercalated between the skeletal frame and the integumental frame, for connecting the frames to each other; and wherein the skeletal frame, the integumental frame and the connection member is injection molded from a composition comprising a ratio of 100 parts by weight of synthetic resins and 2 to 25 parts by weight of an infrared radiation-emitting and anion-generating ore powder selected from the group consisting of illite, sericite, mica, and muscovite.

* * * * *